United States Patent [19]

DeParales et al.

[11] 4,202,459

[45] May 13, 1980

[54] DISPOSABLE CUP COVER

[76] Inventors: Lawrence T. DeParales, 1 Gates Rd., Marshfield, Mass. 02050; Edward P. Billitzer, 24 Water St., East Weymouth, Mass. 02189

[21] Appl. No.: 936,796

[22] Filed: Aug. 25, 1978

[51] Int. Cl.[2] ..... A47G 19/22

[52] U.S. Cl. ..... 220/90.4; 220/254; 220/269; 229/7 R

[58] Field of Search ..... 215/237, 253, 307; 220/90.4, 254, 269; 229/7 R, 7 S, 43

[56] References Cited

U.S. PATENT DOCUMENTS

| | | | |
|---|---|---|---|
| 3,386,613 | 6/1968 | Traynor | 220/269 |
| 3,847,300 | 11/1974 | Waters | 220/269 |
| 3,977,559 | 8/1976 | Lombardi | 220/254 |
| 3,994,411 | 11/1976 | Elfely | 220/90.4 |
| 4,056,210 | 11/1977 | Boyle | 220/90.4 |
| 4,081,103 | 3/1978 | Zoellick | 220/254 |
| 4,106,660 | 8/1978 | Boyle | 220/90.4 |
| 4,113,135 | 9/1978 | Yamazaki | 220/90.4 |

*Primary Examiner*—George T. Hall

[57] ABSTRACT

A disposable cup cover fabricated from a die, wherein a die ordinarily used for the fabrication of disposable cup covers, includes an additional configuration which causes the cup cover to have a separatable pie shaped mouth piece which a user can bend out of the way in order to drink from the cup and with an edge which will mate with a slot in the body of the cover which will receive it and hold it rigidly until it is desired to close the cover again.

1 Claim, 3 Drawing Figures

DISPOSABLE CUP COVER

Disposable cup covers are made of plastic and are ordinarily placed in a die which causes the plastic to produce a lip or rim which mates with the rim of the glass or plastic cup currently being sold. These dies produce cup covers of this nature in the millions. A draw back from these covers is that the cup cover must be removed before someone can drank the contents. Accordingly, numerous cup covers have been suggested which permit one to move some portion of the top which will permit one to draw off the contents of the cup. Some have even gone so far as to be able to lock the top open. It is therefore apparent that a very desirable cup cover is one in which someone can open the top partially, remain open such that it does not interfere with the use of the cup for drinking purposes, yet be reclosable. The prior art configurations vaguely permit reclosing or resealing. Resealing the cup cover onto the cup is advantageous between drinks particularily in a motor vehicle.

Prior art cup covers have required additional material as other paraphernalia, which, of course, increases its cost. The present inventors have discovered a way to shape a die, ordinarily used, for the production of inexpensive disposable cup covers, to slightly modify it which will not incur any increased cost with respect to materials or fabrication. The resulting cup cover is both disposable, openable and resealable by means of a simple thumb operation of the user heretofore unavailable in the prior art.

Therefore, an object of the present invention is to provide a thumb operated resealable disposable cup cover.

Another object of the present invention is to provide a resealable cup cover with means for holding the opened segment in an open position.

Another object of the present invention is to provide a disposable resealable cup cover which does not incur any additional cost over a conventional cup cover.

Other objects, features and advantages of the present invention will be better understood from the following detailed specification when read in conjunction with the attached drawings of which:

Figure 1:
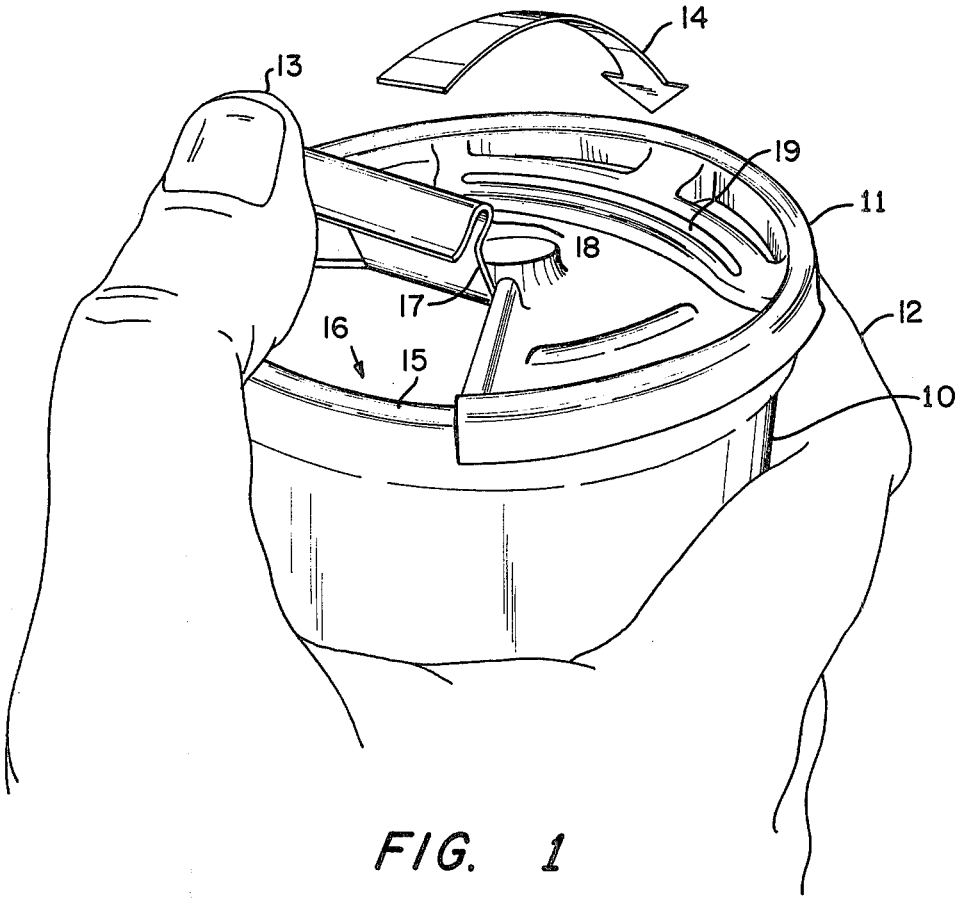
FIG. 1 is a perspective view of the present invention.

Referring to FIG. 1 we see a cup cover 11 which has a cup 10 over which a cup cover 11 is placed such that the perimeter 15 engages the cup cover. This is the common practice for cup covers of the disposable kind. The cup is usually of styrofoam and the cup cover is a very thin wafer type of plastic. We see the user 12 extending his thumb 13 (pushing the cover segment in the direction 14). The cup segment 17 disengages at its perimeter 18, and when pushed far enough it engages the slot 19, which causes the perimeter to be held in place. The user can then drink the contents 16 out of the cup by placing the rim 15 to his lips and tipping the cup in the usual manner.

Figure 2:
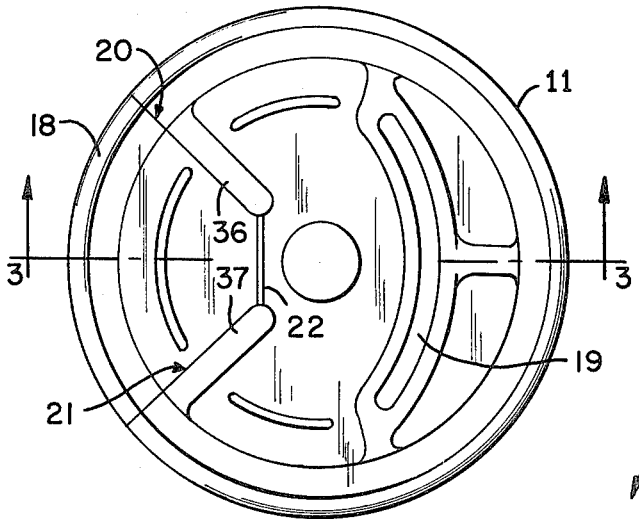
FIG. 2 is a top view of the cup cover.

Referring now to FIG. 2 we see the cup cover 11 from its top view. The segment 18 is reinforced at section 22 permitting the unit to be bent numerous times before breaking. We also note that the rim is cut by the die (in fabrication) at 20 and 21 all the way to the reinforced segment 22. This enables the user to snap it up and down. The reinforcing ribs 37 and 36 serve another function. They ordinarily would just make the flat cup cover rigid; but in this case, they permit the segment 18 to engage on a friction basis, the sides of ribs 37 and 36 such that it is locked down in place when the cup cover is closed after use. The rim of the cup 15 re-engages the perimeter 18 such that it is locked very tightly in place permitting virtually no fluid to leave the cup.

Figure 3:
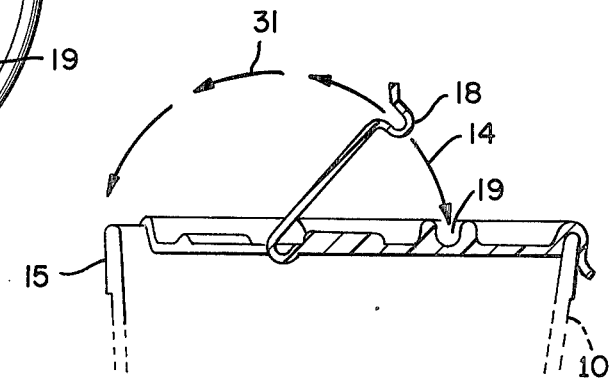
FIG. 3 is a side sectional view of the cup cover in operation.

Referring now to FIG. 3 we see a sectional view of the cup and the cup cover. The cup cover segment can go in either of two directions 14 or 31. When it is pushed to its limit it engages slot 19 wherein the segment is held in an open position. When a user pushes against the edge of the perimeter 18 it disengages with slot 19 and goes in direction 31 until the rim of the cup 15 re-engages perimeter 18 of the segment locking it in a closed position.

An ordinary cup cover as currently used is only modified in its configuration by the die. No additional material is added or subtracted from the conventional cup cover. Ordinary reinforcing ribs are rearranged in order to provide a mechanism for locking the cup cover in an open position and letting it be reclosed such that the ribs hold it in a tightly closed position. No prior art devices have been able to achieve this without considerable expense and complexity and without considerable effort and difficulty.

Although we have described our invention with reference to specific apparatus, we do not wish to be limited thereby, we only wish to be limited by the appended claims:

We claim:

1. A disposable cup cover comprising, a flat plastic disc having in combination, a perimeter extending downwardly for engaging the edge of a cup, a pie shaped segment disengagable from the cup cover whereby an edge of the cup is exposed for drinking purposes, an arcuate recess in said disc for receiving the perimeter of the pie shaped segment whereby the cover segment is disengagably held in open position during drinking a pair of reinforcing ribs adjacent the radial edges of said segment for frictionally holding said segment in a virtually liquid sealing position when closed.

* * * * *